US006775656B1

(12) United States Patent
Gettwart et al.

(10) Patent No.: US 6,775,656 B1
(45) Date of Patent: Aug. 10, 2004

(54) METHOD FOR AUTOMATIC INSTALLATION OF FRANKING DEVICES AND ARRANGEMENT FOR THE IMPLEMENTATION OF THE METHOD

(75) Inventors: Klaus Gettwart, Volten (DE); Olaf Turner, Berlin (DE); Dieter Pauschinger, Berlin (DE)

(73) Assignee: Francotyp-Postalia AG & Co. (DE)

( * ) Notice: Subject to any disclaimer, the term of this patent is extended or adjusted under 35 U.S.C. 154(b) by 0 days.

(21) Appl. No.: 09/528,468

(22) Filed: Mar. 17, 2000

(30) Foreign Application Priority Data

Mar. 17, 1999 (DE) ..... 199 13 067

(51) Int. Cl.[7] ..... G07B 17/00

(52) U.S. Cl. ..... 705/401; 713/1

(58) Field of Search ..... 705/401, 403, 705/410; 713/1, 2, 100

(56) References Cited

U.S. PATENT DOCUMENTS

| | | | | |
|---|---|---|---|---|
| 4,752,950 A | * | 6/1988 | Le Carpentier | 379/106.11 |
| 4,831,554 A | | 5/1989 | Storace et al. | 364/519 |
| 4,864,506 A | * | 9/1989 | Storage | 705/403 |
| 4,933,849 A | | 6/1990 | Connell et al. | 364/400 |
| 5,077,660 A | | 12/1991 | Haines et al. | 364/464.02 |
| 5,161,109 A | | 11/1992 | Keating et al. | 364/464.02 |
| 5,233,657 A | | 8/1993 | Günther | 380/23 |
| 5,471,925 A | | 12/1995 | Heinrich et al. | 101/91 |
| 5,612,884 A | | 3/1997 | Haines | 364/464.13 |
| 5,699,415 A | | 12/1997 | Wagner | 379/106 |
| 5,710,706 A | | 1/1998 | Märkl et al. | 364/464.19 |
| 5,734,571 A | * | 3/1998 | Pilz et al. | 705/400 |
| 5,812,400 A | | 9/1998 | Eddy et al. | 364/464.2 |
| 5,852,813 A | | 12/1998 | Guenther et al. | 705/408 |
| 5,880,747 A | | 3/1999 | Bartenwerfer et al. | 347/4 |

FOREIGN PATENT DOCUMENTS

| | | | |
|---|---|---|---|
| DE | OS 41 07 030 | | 9/1992 |
| DE | 196 05 015 | | 6/1997 |
| DE | OS 197 11 997 | | 9/1998 |
| DE | PS 197 26 642 | | 9/1998 |
| EP | 0388839 | A2 * | 9/1990 |
| EP | 0 388 840 | | 9/1990 |
| EP | 0 442 761 | | 8/1991 |
| EP | 0 493 949 | | 7/1992 |
| EP | 0760335 | A2 * | 3/1997 |

(List continued on next page.)

OTHER PUBLICATIONS

Business Wire: "Pitney Bowes Names Winner of it's Seventh Annual Inventor of Year Award"; Jun. 07, 1999, p. 1260.*

*Primary Examiner*—Edward R. Cosimano
(74) *Attorney, Agent, or Firm*—Schiff Hardin LLP

(57) ABSTRACT

In a method for automatic installation of a franking device, and a franking device operating according to the method, a self-test is conducted in the franking device in order to determine whether an automatic installation is to be implemented and a loading of a customer-specific data set is to be undertaken into a non-volatile memory or, if an installation has already ensued earlier, whether the installation procedure need not be implemented. In the automatic installation procedure, A mirror data set is produced at a data center, corresponding to the machine data stored in the franking device, and the mirror data set is stored in the data center allocated to a numerical code. Customer data for a sold franking device are communicated to the data center. The customer data are stored in the data center allocated to the numerical code. A machine-specific and customer-specific data set is made available in the data center allocated to the numerical code, this the data set including at least data for a specific stamp with temporary and local data. The data set is communicated to the franking location after a reception of corresponding request data or inputs.

9 Claims, 6 Drawing Sheets

FOREIGN PATENT DOCUMENTS

| | | | |
|---|---|---|---|
| EP | 0 789 333 | | 8/1997 |
| EP | 0 825 562 | | 2/1998 |
| EP | 0 854 446 | | 7/1998 |
| EP | 0 892 367 | | 1/1999 |
| GB | 2188875 A | * | 10/1987 |
| WO | WO 99/66422 A1 | * | 12/1999 |

* cited by examiner

METHOD FOR AUTOMATIC INSTALLATION OF FRANKING DEVICES AND ARRANGEMENT FOR THE IMPLEMENTATION OF THE METHOD

BACKGROUND OF THE INVENTION

1. Field of the Invention

The present invention is directed to a method for the automatic installation of a franking device as well as to an arrangement for the implementation of the method, particularly such a method and arrangement that are suitable for users of all types of mail processing systems, accounting or security modules, postage meter machines or PC franking devices, particularly for making a franking device available for use by a customer rapidly after purchase of the device.

2. Description of the Prior Art

Before a postage meter machine can be used as intended, certain country-specific, carrier-specific and customer-specific data must usually still be stored in the postage meter machine by the dealer. Given postage meter machines of the type T1000 from Francotyp-Postalia AG & Co., a specific EPROM for such an installation is plugged in by the dealer or service technician (see U.S. Pat. No. 5,734,571 and European Application 762 335, method for modifying data of an electronic postage meter machine loaded into memory cells). A standard approach is to simultaneously store an identification number in a data center in order to be able to identify the franking device later when it calls in to the data center. The acquisition of customer data is also known from other devices.

The involvement of a remote data center is likewise already standard. U.S. Pat. No. 5,233,657 discloses loading data before an initialization of a postage meter machine. For changing advertising slogans, U.S. Pat. No. 4,831,554, discloses the use of a telephone communication. A date-dependent changing of the stamp (franking imprint) formats (with municipality stamp and with value stamp) that was loaded by modem at an earlier point in time is disclosed in U.S. Pat. No. 4,933,849. U.S. Pat. No. 5,161,109 discloses loading data banks, with a standard data bank serving the purpose of storing data in the form of a data set that is periodically communicated from the postage meter machine to the center. The data set is then updated in the data center and is then returned to the postage meter machine updated (downloading).

Following an initialization, European Application 780 803 discloses making news or carrier-specific advertising available from a data center when there is a request for this in the data center. To this end, the customer must have previously entered into a contract with the service provider or operator of the data center.

U.S. Pat. No. 5,077,660 discloses a method for changing the configuration of the postage meter machine, wherein the postage meter machine is switched from the operating mode into a configuration mode with a suitable input via a keyboard, and a new meter type number can be entered that corresponds to the desired number of features. The postage meter machine generates a code for the communication with the computer of the data center and the entry of the identification data and the new meter type number in the aforementioned computer, which likewise generates a corresponding code for communication and input into the postage meter machine, wherein the two codes are compared. Given agreement between the two codes, the postage meter machine is configured and switched into the operating mode.

As a result, the data center always has precise entries of the currently set meter type for the corresponding postage meter machine. In this method, however, security is dependent only on the encryption of the transmitted code.

European Application 388 840 discloses a comparable security technique for setting a postage meter machine in order to clean it of data without having to transport the postage meter machine to a representative of the manufacturer. Again, security is only dependent on the encryption of the transmitted code.

SUMMARY OF THE INVENTION

An object of the present invention is to provide a method for automatic installation and an appertaining arrangement, particularly a corresponding franking means. The customer who has acquired a pre-initialized franking device from a dealer should be able to place the franking device completely into operation without having to call a customer service representative or service technician and without having to visit the post office.

This object is achieved in the inventive method and apparatus wherein, during manufacture, machine data are entered into the franking device by a known means when the franking device is pre-initialized, with the following steps being inventively conducted.

A mirror data set, corresponding to the machine data stored in the franking device is stored in the data centered allocated to a numerical code.

Acquired customer data of a purchased franking means are communicated to the data center.

The customer data are stored in the data center allocated to the numerical code.

A machine-specific and customer-specific data set is made available in the data center allocated to the numerical code, this data set including at least data for a specific stamp with temporary and local data.

The data set is communicated to the franking location (franking device or the operator thereof) after reception of corresponding request data or inputs.

The machine data are the serial number and/or identification number.

Request data are already generated when the franking device implements the loading of a credit preceding its use. It is advantageous for the franking device additionally to implement—during the loading event—an accounting of the desired service of the data update for an installation of stamp content data.

The data set communicated for automatic installation can contain a customer-specific advertising slogan or an advertising slogan selected from a number of advertising slogans, and also can include customer data when this has been agreed upon at the time of purchase.

The customer data (for example place of utilization, slogan request, service/maintenance contract) are communicated in the framework of the setup of a first communication by postcard, by telephone or a comparable communication, directly or, if necessary, via a dealer, to the data center. The data center is preferably fashioned as a first, specific service center (data update server) that, as needed, can also communicate other configuration data and postage fee table data. This same data center or a second data center can be fashioned as a reloading center for credit. Usually, the second (telepostage) data center communicates the credit required for franking in the form of reload data.

The same data center or a third data center can be fashioned as a reloading center for fee tables and for further information.

The data center has a transmission arrangement in order to supply customer-specific data sets. The communication of the data set then ensues by transmission from the data carrier.

A customer-specific data set thus can be supplied to the customer via a chip card or some other modern medium.

The method and arrangement can be used to particular advantage to reduce the cost or maintain a competitive cost of machines that a dealer distributes. The time from the order/purchase of the customer up to the first franking event can be drastically reduced. Due to the transmission of data for a country-specific value stamp image, the country versions can be replaced by a single version, for example by a Europe version.

DESCRIPTION OF THE PREFERRED EMBODIMENTS

Figure 1:
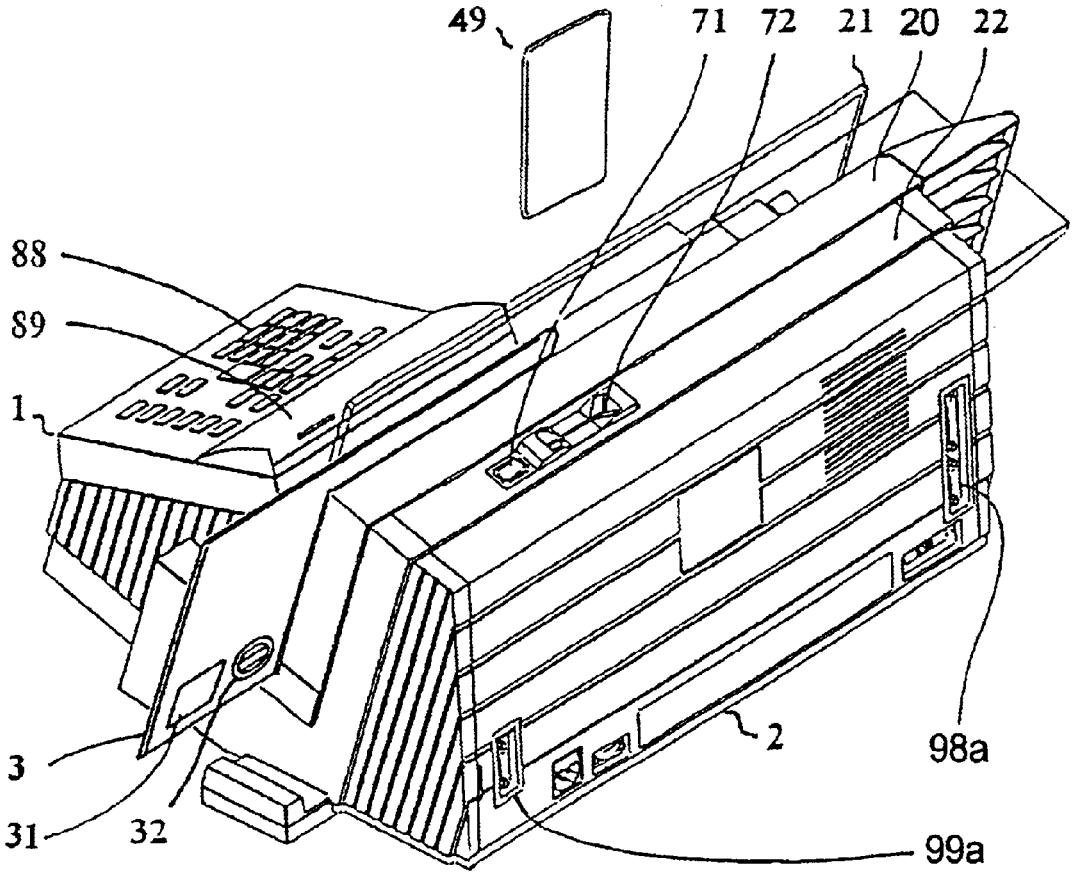
FIG. 1 is a perspective view of a postage meter machine operating according to the inventive method, from the back right.

FIG. 1 shows a perspective view of a postage meter machine of the type JetMail® from the back right. This postage meter machine is composed of a meter 1 and a base 2. The base 2 is equipped with a chip card write/read unit 70 that is arranged behind the guide plate 20 and is accessible from the upper edge 22 of the housing. After the postage meter machine is switched on with a switch 71, a chip card 49 is inserted into the insertion slot 72 from top to bottom. (The chip card 49 represents all different chip cards which may be utilized). A letter 3 supplied standing on edge, and that has its surface to be printed lying against the guide plate 20, is then printed with a franking stamp 31 and a municipal stamp 32 in conformity with the input data. The letter delivery opening is laterally limited by a transparent plate 21 and by the guide plate 20.

Figure 2:
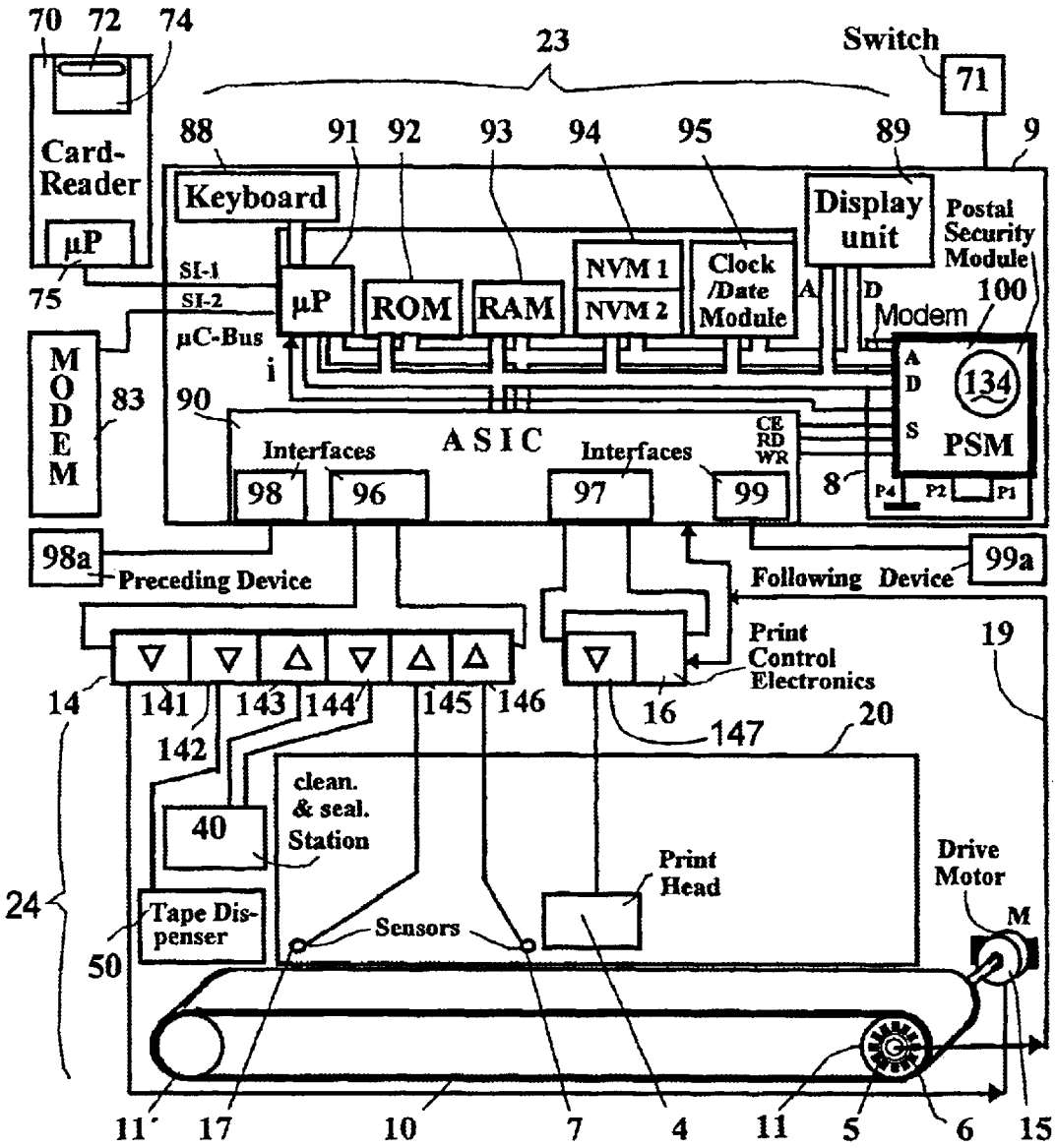
FIG. 2 is a block circuit diagram of the controller of a postage meter machine operating according to the inventive method.

FIG. 2 shows a block circuit diagram of a postage meter machine that is equipped with a chip card write/read unit 70 for reloading change data or operating data or customer data by a chip card 49 and is equipped with a printer 24 that is controlled by a control device 23. The control device 23 contains a motherboard 9 equipped with a microprocessor 91 with appertaining memories 92, 93, 94, 95. The program memory 92 contains an operating program at least for printing and security-relevant components of the program for a predetermined format change of a part of the operating data.

The main memory RAM 93 serves the purpose of volatile buffer storage of intermediate results. The non-volatile memory NVM 94 serves the purpose of nonvolatile buffer storage of data, for example statistical data, that are organized according to respective cost centers. The calendar/clock module 95 likewise contains addressable but non-volatile memory areas for the non-volatile buffer storage of intermediate results or of known program parts as well (for example, for the DES algorithm). The control unit 23 is connected to the chip card write/read unit 70, with the microprocessor 91 of the control means 1 being programmed, for example, for loading the operating data N from the memory area of a chip card 49 into corresponding memory areas of the postage meter machine. A first chip card 49 inserted into a plug in slot 72 of the chip card write/read unit 70 allows a reloading of a data set into the postage meter machine for at least one application. The chip card 49 contains, for example, the operating data for setting a cost center.

The control unit 23 forms the actual meter 1 with the components 91 through 95 of the aforementioned motherboard 9. The meter 1 also has a keyboard 88, a display unit 89 as well as an application-specific circuit (ASIC) 90, and an interface 8 for the postal security module (PSM) 100. The security module (PSM) 100 is connected via a control bus to the aforementioned ASIC 90 and to the microprocessor 91 and is also connected via the parallel $\mu$C bus at least to the components 91 through 95 of the motherboard 9 and to the display unit 89. The control bus carries lines for the signals CE, RD and WR between the security module 100 and the aforementioned ASIC 90. The microprocessor 91 preferably has a pin for an interrupt signal i emitted by the security module 100, further terminals for the keyboard 88, a serial interface SI-1 for the connection of the chip card reader unit 70 and a serial interface SI-2 for the optional connection of a modem 83. With the modem 83, for example, the credit stored in the non-volatile memory of the postal security module 100 can be incremented.

The postal security module 100 is surrounded by a secured housing and has a back-up battery 134. Before every franking imprint, a hardware accounting is implemented in the postal security module 100. The accounting ensues independently of cost centers. The postal security module 100 can be internally implemented as described in detail in European Application 789 333.

Alternatively, a version without the postal security module 100 can also be realized. Given such a version, the processor 91 assumes the tasks of the security module. The ASIC 90 has a serial interface circuit 98 to a preceding device 98*a* in the mail stream, a serial interface circuit 96 to sensors and actuators of the printer 24, a serial interface circuit 97 to the print control electronics 16 for the ink jet print head 4 of a printer and a serial interface circuit 99 to a device 99*a* following the printer 24 in the mail stream. German OS 197 11 997 describes a modified embodiment of the peripheral interface that is suitable for a number of periphery devices (stations). The interface circuit 96 coupled to the interface circuit 14 located in the machine base 2 produces at least one connection (ports 145, 146) to sensors and to actuators, for example an actuator for a drive motor 15 (port 141), a cleaning and sealing station 40 (ports 143, 144), the print head 4 (port 147), as well as for a tape dispenser 50 in the machine base 2 (port 142). The fundamental arrangement and interaction between the print head 4 and the cleaning and sealing station 40 are known from German PS 197 26 642.

One of the sensors arranged in the guide plate 20 is a sensor 17 which serves for preparation of print triggering given letter transport. The sensor 7 serves for recognizing the leading edge of the letter 3 for triggering printing given letter transport. The conveyor is composed of a conveyor belt 10 and two drums. One of the drums is the drive drum 11 equipped operated by the motor 15, the other is the entrained tensioning drum 11'. Preferably, the drive drum 11 is a toothed drum; correspondingly, the conveyor belt 10 is preferably a toothed belt, for producing positive force transmission. An encoder is coupled to one of the drums 11, 11' (the drive drum 11 in this exemplary embodiment). The drive drum 11 has an incremental generator 5 firmly seated on its shaft. The incremental generator 5 is, for example, a slotted disk that interacts with a light barrier 6 and emits an encoder signal via the line 19 to the motherboard 9. The basic structure of the printer is disclosed in detail in, for example German PS 196 05 014 and German PS 196 05 015.

The individual print elements of the print head 4 are connected within its housing to print head electronics 16, and the print head 4 can be driven for purely electronic printing. The print control ensues on the basis of the path control of the letter 3, with the selected stamp offset being taken into consideration, this being entered via the keyboard 88 or the chip card 49 as needed and being stored in non-volatile fashion in the memory (NVM) 94. An intended imprint thus is produced from the stamp offset (without printing), from the franking imprint format and, if present, further print images for advertising slogan, shipping information (selective prints) and additional messages that can be edited. The non-volatile memory 94 has a number of memory areas. These include memory areas that store the loaded postage fee tables in non-volatile fashion.

The chip card write/read unit 70 is composed of a mechanical carrier for the microprocessor card and a contacting unit 74. The latter allows a reliable mechanical holding of the chip card 49 in a read position and unambiguous signaling of when the read position of the chip card 49 is reached in the contacting unit 74. The microprocessor card with the microprocessor 75 has the programmed capability to read all types of storage cards or chip cards. The interface to the postage meter machine 1 is a serial interface according to the RS 232 standard. The data transmission rate is to a minimum of 1.2 K Baud. The activation of the power supply ensues with the switch 71 connected to the motherboard 9. After the power supply is switched on, a self-test is carried out. A requirement for automatic installation can thereby be found. A readiness message ensues after the installation.

The modem 83 is particularly advantageous for recrediting, but is also inventively utilized in order to load further operating data and customer data. Usually, the reloading tasks are divided, so that one part can be implemented by modem and another part can be implemented by chip card. A mixed method is also possible that simultaneously operates with a chip card and with voice communication by telephone. The latter allows credit reloading. The required print image data, of course, cannot be communicated by voice but are stored in a chip card 49 that is sent to the customer. The customer must wait to receive this chip card 49.

It is especially advantageous when the initial installation is enabled by modem because the waiting times are then minimum and because the automatic installation can also be coupled to a credit reloading procedure.

Figure 3:
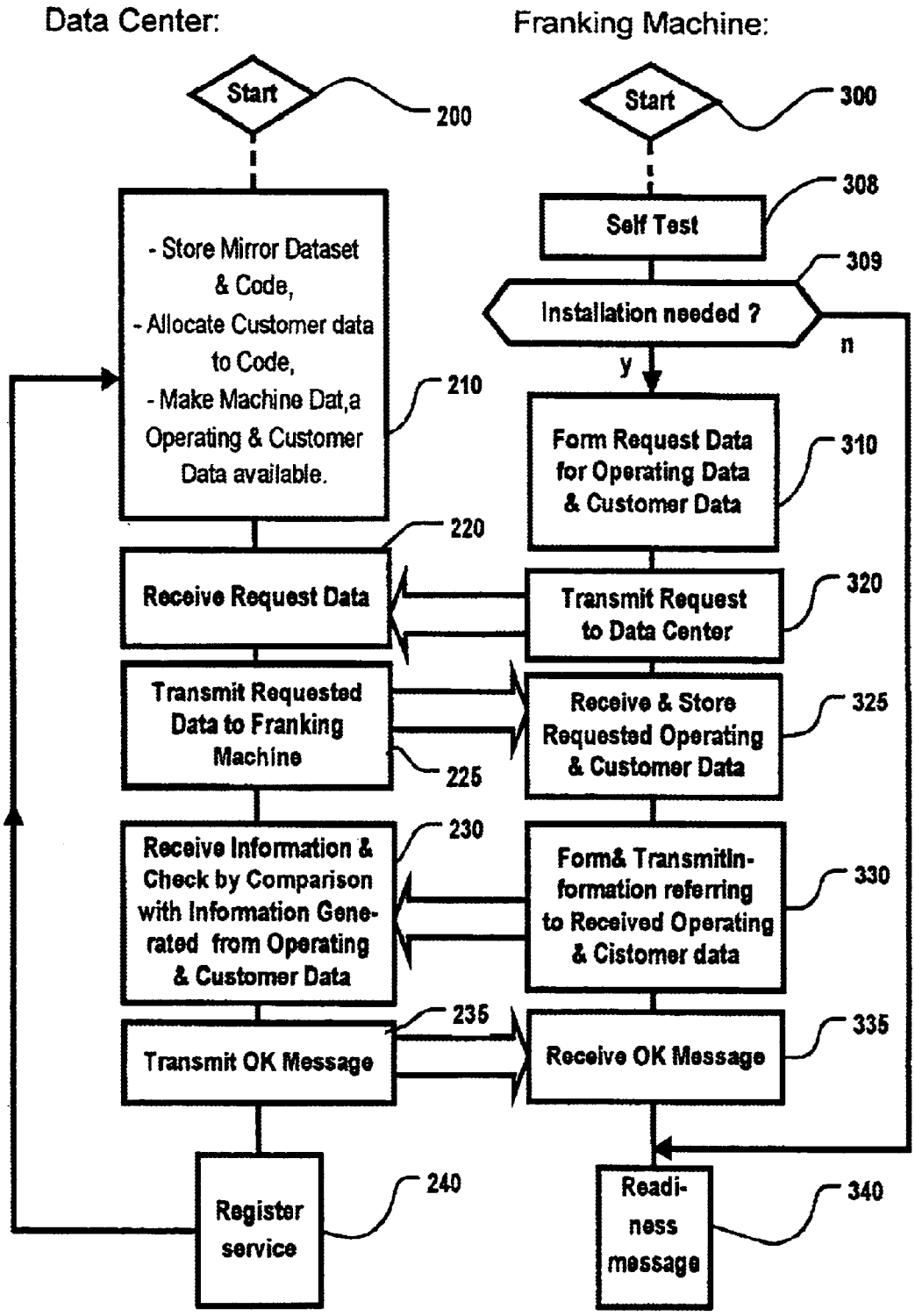
FIG. 3 is a flowchart for a communication by modem in the context of the inventive method.

FIG. 3 shows a flowchart for a communication between postage meter machine 1 and a remote data center via the modem 83 shown in FIG. 2 and a communication network, which enables the initial installation by the modem 83 alone. The manufacture of the postage meter machine 1, into which machine data were stored, precedes the start step 200. The machine data include the postage meter machine serial number and other identification data. In addition to the identification data ID, a secret base key BKE key specific to the postage meter machine 1 is also generated and stored in a read out-protected, non-volatile memory area of the postage meter machine 1, preferably in the postal security module 100. The secret base key BKE key allows the later decryption of encrypted messages that are exchanged during a communication with a key distribution central KDC in order to acquire session keys SK. Such session keys SK can be changed at time intervals and serve the purpose of exchanging an encryption key KEK that is changed from communication to communication. The encryption key KEK is the key for, for example, a DES encryption (data encryption standard). In a simplified version of the pre-initialization of the postage meter machine 1 (without the key distribution central KDC), of course, a start key KEK can also be stored that is required for an initial communication with the data center, at least for credit reloading. Simultaneously with the pre-initialization of the postage meter machine 1, a code is also generated according to a method which is maintained secret. In step 200, a mirror data set allocated to the aforementioned machine data is communicated and is stored (step 210) in the data bank DB of the data center. The code can, for example, be a numerical code. After the end of this first phase a, the manufactured postage meter machine 1 can be distributed by the dealer and can be sold. At the time of sale, phase b begins with the acquisition of the customer data by the dealer, who also knows the numerical code. After the data transmission (phase b), the customer data allocated to the numerical code are stored in the data bank DB of the data center in phase c. The data center makes machine, operating and customer data available such that the postage meter machine 1 also receives at least the operating data simultaneously with an initial loading of a credit, these data being required for franking. When the purchaser starts the postage meter machine 1 (step 300) by turning it on and a requirement is recognized as a result of a self-test (step 308) in the interrogation step 309, then an automatic installation routine is implemented in the postage meter machine 1. The operating data that are required are prescribed by regulations of the mail carrier and encompass at least the print image data for a stamp with temporary local data (for example, a location-specific municipal stamp) and a carrier-specific, area-specific or country-specific value stamp. The formation of request data for such operating data and other customer data such as, for example, advertising slogan data, ensues in the first step 310 of the automatic installation routine. In phase d, a communication of the data set to the postage meter machine 1 ensues after reception of corresponding request data, this being explained in greater detail with reference to the following steps.

If the result of the interrogation in step 309 is negative, the program proceeds directly to step 340 and a readiness message is displayed.

In a first communication between the postage meter machine 1 and the data center, a transmission 320 of the request data ensues in order to request the operating data and customer data from the data center. This communication includes reception (step 220) of the request data in the data center and a transmission (step 225) of the requested operating data and customer data to the postage meter machine 1, and communication (step 325) for receiving and storing the requested operating data and customer data.

In a second communication (step 330) between the postage meter machine and the data center, a transmission of information from the postage meter machine to the data center ensues that refers to the stored operating data and customer data. In step 230 the data center for receives and checks the information by a comparison with information generated from the operating data and customer data, and in a step 235 the data center sends an "okay" message to the postage meter machine 1 and with reception (step 335) of the "okay" message in the postage meter machine 1 and output of a readiness message (step 340).

In conjunction with the sending of the "okay" message, a registration (step 240) of the service ensues in the data center, and upon reception of the "okay" message in the postage meter machine 1, a marking of the stored data as being valid is registered, as a flag that the service was registered in the data center for the purpose of payment. For such marking, a bit is either set in a secure region in the non-volatile memory of the postage meter machine or corresponding data secured by a signature or by MAC-protection are stored. The information to be checked is, for example, a checksum or an encrypted checksum formed over the communicated data.

Figure 4:
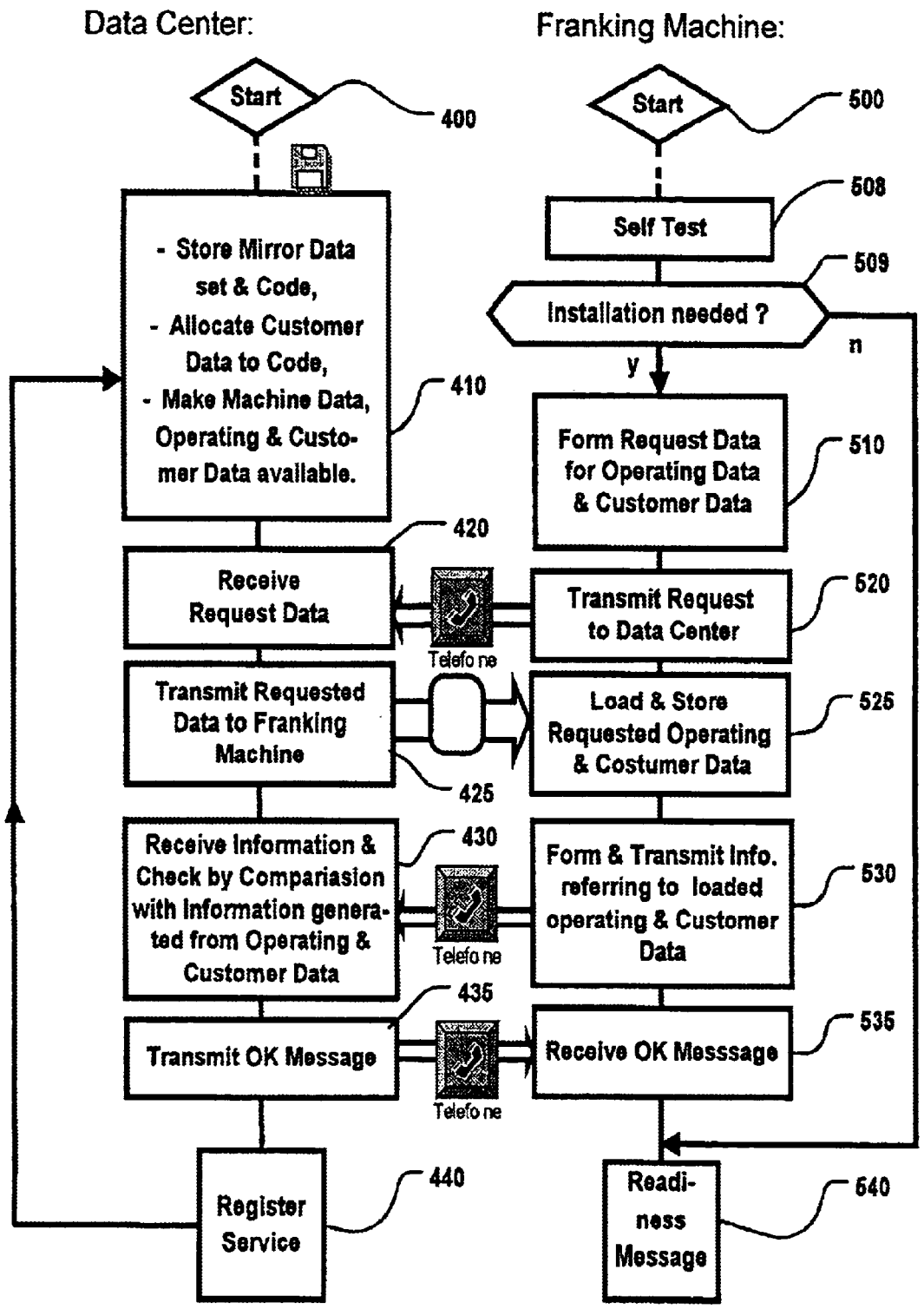
FIG. 4 is a flowchart for a communication by voice in the context of the inventive method.

FIG. 4 shows a flowchart for a communication between postage meter machine 1 and a remote data center by voice and, conversely, by voice and data carrier. During manufacture of the postage meter machine 1 in which machine data were stored, a mirror data set for the aforementioned machine data is stored in a data carrier. Simultaneously with the pre-initialization of the postage meter machine 1, a code is also generated according to a method which is maintained secret. This is likewise stored in the data carrier, for example a diskette or chip card, allocated to the mirror data set. The data carrier is transported to the data center (service center) in order to store the data in the data bank DB. After the start 400, a mirror data set for the aforementioned machine data allocated to the generated code is stored in the data bank DB of the data center in step 410. The code, for example, can be a numerical code. The data bank DB is connected via a server to a chip card write unit. After the end of this first phase a, the manufactured postage meter machine 1 can be distributed and sold by the dealer. The customer-specific data set can be supplied to the purchaser of an appertaining postage meter machine 1 via a chip card 49 or some other modern medium. Phase b begins at the time of sale with the acquisition of the customer data by the dealer, who also knows the numerical code. In phase c, the dealer stores the acquired customer data in the data bank DB of the data center allocated to the numerical code. The data center then makes machine data, operating data and customer data available so that the postage meter machine also receives at least the operating data required for franking together with an initial loading of a credit. In the store, the purchaser only needs to acquire the machine and takes it to the place of use From there, the user sends a postcard that was included with the machine packaging. This postcard contains information which is thus forwarded to the manufacturer, including

- the machine number (that can be printed or glued on the postcard),
- the address of the location of the machine with postal zip code (PLZ), and
- a desired standard template selected by the purchaser or the operator from a number of templates.

When the customer information has already been acquired by the dealer under a numerical code, indicating the numerical code suffices. Further, the customer authorizes a bank, by the signature of an authorized representative of the customer, for debiting to pay for services of the data center. A duplicate of the postcard is sent to the bank that certifies the authenticity of the signature and the credit rating of the customer. After a positive action on the part of the bank to the dealer or the distributor of the data bank or postage meter machine manufacturer, the customer data are allocated to the data set in the data center. The data of the advertising slogan (if selected), the municipal postmark "town circle" and the country-specific value stamp are compiled in a data set for this customer.

When the operator (purchaser) starts the postage meter machine (step 500) by turning it on and, as a result of a self-test (step 508) recognizes a requirement in interrogation step 509, then an automatic installation routine sequences in the postage meter machine in which the machine operator is prompted to request operating data and customer date (step 510). The required operating data are prescribed by regulations of the mail carriers and cover at least the print format data for a location-specific municipal postmark and a carrier, area or country-specific value stamp. In a first step 520 of the automatic installation routine, a call of the operator to the data center and communication of the numerical code by voice ensues. Alternatively, the numerical code can be communicated by letter.

If the result of the interrogation in step 509 is negative, the program proceeds directly to step 540 and a readiness message is displayed.

Following the first communication of the operator of the postage meter machine with the data center, including a transmission 520 of the numerical code in order to request the operating data and customer data from the data center, phase d begins. In phase d, a communication of a data carrier ensues to the operator of the franking device at the franking location, for giving the operator possession of the desired data set, for example by sending a chip card. The data carrier (chip card) also contains information related to the operating data and customer data to be communicated. In the framework of the first communication of the data center with the operator of the postage meter machine, a reception (step 420) of the numerical code initially ensues in the data center and storage of the requested operating data and customer data in a data carrier, including the shipping thereof (step 425) to the operator of the postage meter machine. The operator waits to receive the data carrier in the mail, whereupon step 525 for receiving and storing the requested operating data and customer data in the postage meter machine ensues. A second voice communication 530 of the operator of the postage meter machine with the data center includes communication of information that refers to the stored operating data and customer data. In the second communication, including a reception step 430, a check of the information ensues in the data center with comparison information generated from the operating data and customer data, followed by step 435 for communicating a voice message to the operator of the postage meter machine. Registration (step 440) of the service ensues in the data central in conjunction with the communication of the voice message, after which the data center is re-set to the beginning of the loop to step 410 to await new data for a step 410. After reception of the voice message (step 535), input thereof into the postage meter machine ensues, and the output of a readiness message ensues given proper installation.

Figure 5:
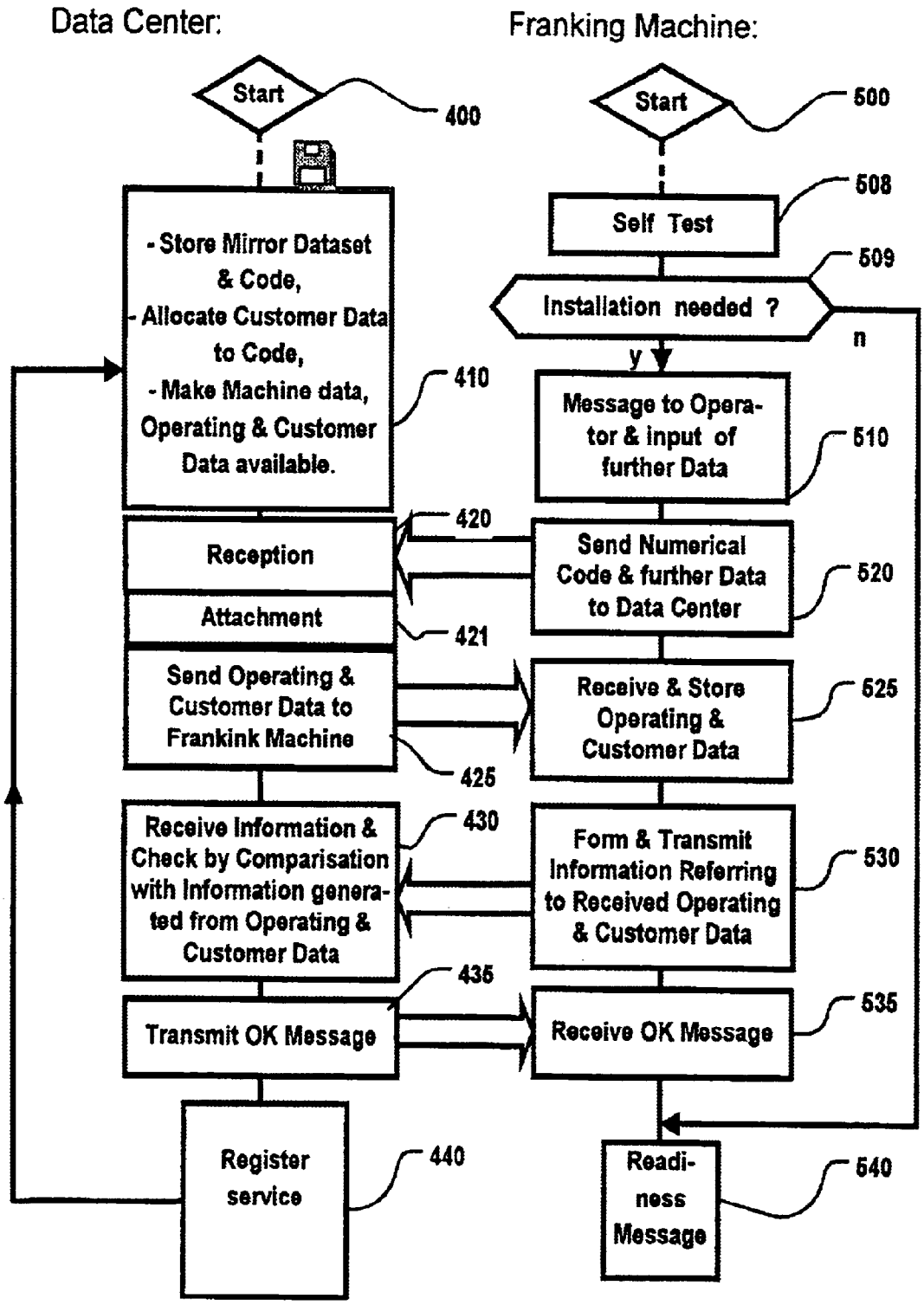
FIG. 5 is a flowchart for a semi-automatic communication by modem in the context of the inventive method.

FIG. 5 shows a flowchart of a semi-automatic communication by modem. When, following the self test 508, it is recognized in step 509 at the franking device that an installation is required, a message to the operator ensues in step 510 with respect to the operating data and customer data that are still to be loaded. At the same time, an input by the operator is possible, for which reason that step is also referred to below as input step 510. The difference from the version already explained is that, following the input step 510, the further customer requests or information are communicated to the data center in the transmission step 520 from the postage meter machine in addition to the numerical code, the additional data being added to the data carrier as a result. For example, perhaps only the data for the municipal and value stamp have been agreed upon at the dealer's place of business, and the operator decides in favor of an additional advertising slogan at the location of the machine, this being selected or compiled from a catalog. Codes are allocated to the selected slogan or slogan part, which are communicated to the data center as further data in the communication step 520. The user interface 88, 89 is equipped for the implementation of a corresponding operator input. After the reception—in step 420—of corresponding, further data and the numerical code, the attachment is implemented by the data center in at least one further step 421, when the declared payment mode as well as the operating data and customer data already stored in the data set allow this. In a way that is not shown, the steps 510 and 520 at the postage meter machine and the steps 420 and 421 at the data center can sequence repeatedly, corresponding to the number of possible inputs. A number of further steps (not shown) can take place in order to iteratively implement the checking and completion of the data set before it is sent. Also, the data center acknowledges each input or at least one of the inputs. This can ensue with an "okay" message that is communicated to the postage meter machine 1. The acquisition of further customer data (phase b) is then carried out by the data center immediately before the initial installation of the postage meter machine 1.

Of course, this assumes a number of operating data types or sets are stored in the data bank of the data center in order to be able to undertake a selection therefrom with respect to the operating data that the customer requests as customer data within the framework of the first communication. The storing and offering of customer data allocated to the numerical code (phases d and d) subsequently ensues, likewise proceeding from the data center immediately before the initial installation of the postage meter machine 1. In the limit case, only the mirror data set is initially stored in the data center in step 410. All further customer data that are acquired, stored and offered in phases b) c) and d), however, are added thereto in the first communication by modem only after the purchase of the postage meter machine 1 (steps 420, 421).

Figure 6:
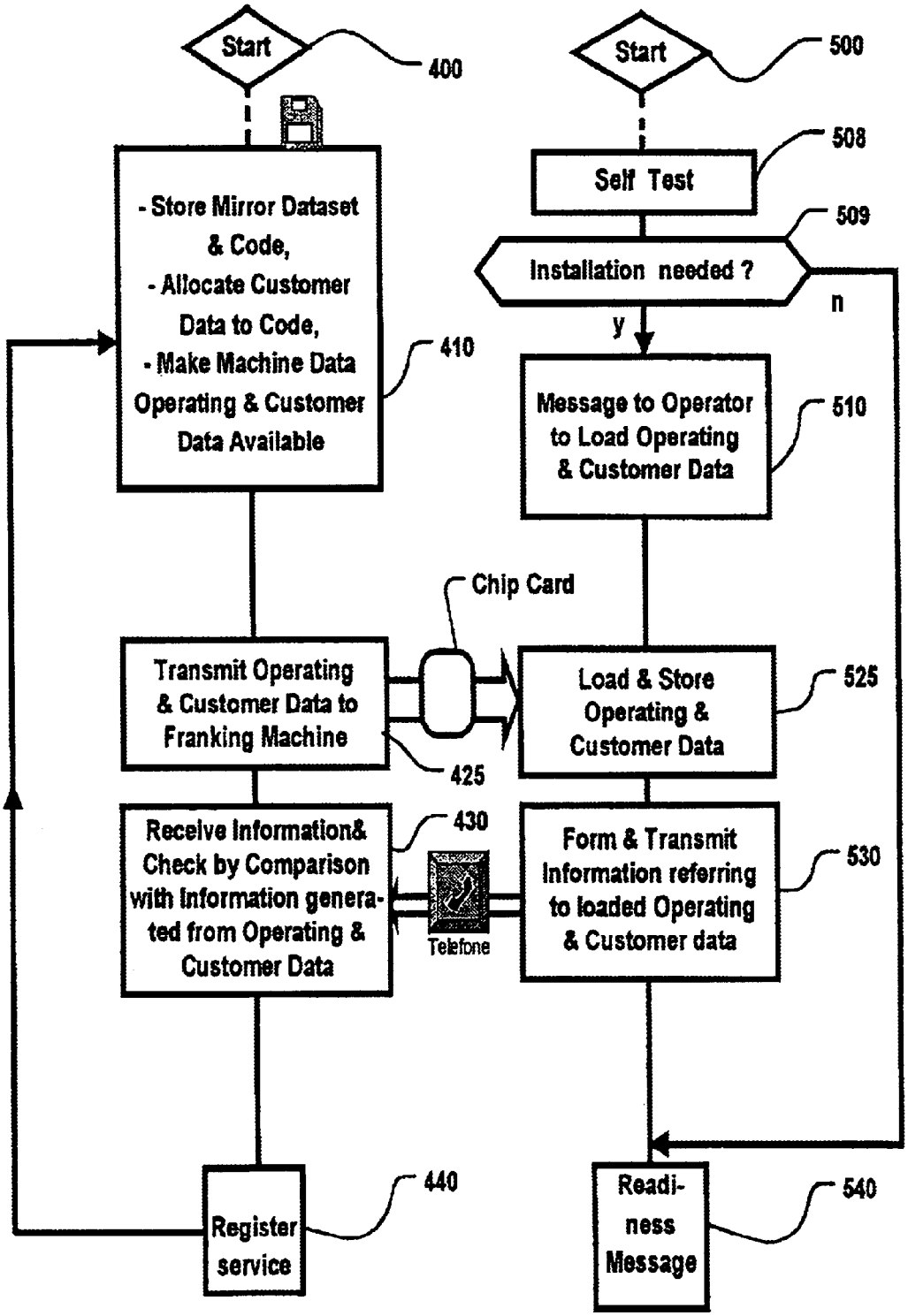
FIG. 6 is a flowchart for an alternative communication in the context of the inventive method.

FIG. 6 shows a flowchart for an alternative communication between the postage meter machine 1 and a remote data center. The steps are essentially the same as in the version according to FIG. 4. Differing from the version according to FIG. 4, steps 420 and 520 are eliminated since the data center has been informed by the dealer as to which purchaser requires which data, so that the shipping of the data carrier (chip card) can ensue immediately after the editing of the machine, operating data and customer data. The postage meter machine, of course, must have a corresponding chip card read unit. For acknowledging reception at the franking location, of course, the alternative communication can also ensue via other communication and transmission means. Differing from the version according to FIG. 4, the steps 435 and 535 are also eliminated, since the data center registers every action—but also every omitted action—and there is thus an adequate possibility of monitoring the user behavior. This version of the method includes the following steps.

In a first communication of the data center with the postage meter machine 1, in step 425 the data carrier with the required operating data and customer data is sent to the postage meter machine (at the customer's location).

In a step 525 the requested operating data and customer data are loaded into and stored in the postage meter machine 1.

In a second communication (step 530) between the postage meter machine and the data center, information is communicated from the postage meter machine 1 to the data center that refers to the stored operating data and customer data.

Further steps (not shown) can take place between the aforementioned step 530 and the readiness message in step 540, these being implemented in conjunction with the reloading of a credit into the postage meter machine 1. This can ensue in a known way, with the postal registers and other registers of the non-volatile memory being interrogated. Within the framework of such an interrogation, the information can also be interrogated that is related to the loaded operating data and customer data.

In the arrangement for implementation of the method a processor 91 or a security module 100 of a franking device is programmed to implement a self-test in order to identify whether an automatic installation is to be implemented or, if an installation already ensued earlier, is not to be implemented, whether loading of a customer-specific data set is to be undertaken into non-volatile memories 94, and whether a readiness message for franking is to be output after a successful installation of a customer-specific data set, or whether a readiness message can be output with an installation procedure. In the latter case, an initial installation that already ensued earlier is assumed. The processor 91 or the security module 100 of a franking means is programmed to form and send request data for loading in order to request, to receive and to store the operating data and customer data from the data center, and to implement an additional communication of information from the postage meter machine to the data center that refers to the stored operating data and customer data, and for receiving an "okay" message before output of the readiness message.

Figure 7:
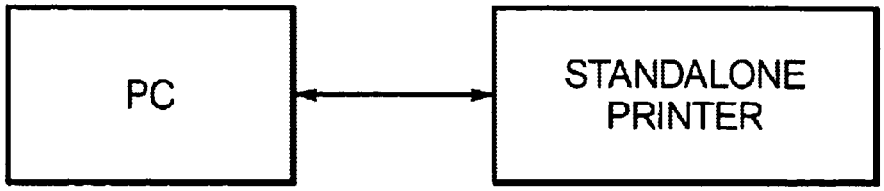
FIG. 7 is a block diagram of another embodiment of the postage meter machine of the invention, as a PC with a stand-alone printer.

The franking means is a postage meter machine having an internal printer as shown in FIGS. 1 and 2 or a PC franker having an external printer as shown in FIG. 7. In the case of the PC franker, a communication by modem and Internet is especially suited.

Alternatively, the processor 91 or the security module 100 of the franking means is programed to undertake the loading of a customer-specific data set from a chip card 49 and storing in the non-volatile memory 94. The loading is accompanied by a voice communication or some other suitable communication with the data center, whereby the data center checks an information that refers to the stored, customer-specific data set.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for automatically installing a franking device into which machine data are written during manufacture of the franking device, comprising the steps of:

at a data center, storing a mirror data set, corresponding to said machine data stored in said franking device, allocated to a numerical code;

acquiring customer data for a user of said franking device and communicating said customer data to said data center;

storing said customer data at said data center allocated to said numerical code;

using said mirror data set and said customer data, producing and making available, at said data center, a machine-specific and customer-specific data set which comprises at least data for a franking imprint with temporary data and local data; and automatically communicating said machine-specific and customer-specific data set directly to said franking device from said data center upon receipt at said data center of a request without a prior communication initiated by the data center to the franking device.

2. A method a claimed in claim 1 comprising additionally storing service data and update data at set data center, and additionally communicating at least one of said service data and said update data directly to said franking device from said data center upon request.

3. A method as claimed in claim 1 comprising the additional step of forming a credit reloading request at said franking device and including said credit loading request in said request to communicate said machine-specific and customer-specific data set.

4. A method as claimed in claim 1 comprising:

establishing said direct communication via a modem between said franking device and said data center;

transmitting request data via said modem directly from said franking device to said data center to request said machine-specific and customer-specific data from said data center;

upon receipt of said request data at said data center, transmitting the requested machine-specific and customer-specific data set from said data center to said franking device;

at said franking device, receiving and storing said requested machine-specific and customer-specific data set in said franking device;

in said franking device, forming information referring to the stored machine-specific and customer-specific data set and transmitting said information via said modem directly to said data center;

receiving said information at said data center and checking said information at said data center by comparing said information to comparison information generated at said data center from said machine-specific and customer-specific data set;

given a positive check result, transmitting an "okay" message via said modem directly from said data center to said franking device at said franking location; and receiving said "okay" message at said franking device and generating a readiness message at said franking device indicating said franking device is available for use.

5. A method as claimed in claim 1 comprising:

storing said machine-specific and customer-specific data set in a physically transportable data carrier;

physically transporting said data carrier from said data center to said franking device at said franking location;

inserting said data carrier at said franking location into said franking device and thereby loading and storing said machine-specific and customer-specific data set into said franking device;

forming information in said franking device referring to the stored machine-specific and customer-specific data set; and communicating said information from said franking device at said franking location to said data center.

6. A method as claimed in claim 1 comprising formulating request data at said franking device and transmitting said request data via a modem at said franking device directly to said data center to request said machine-specific and customer-specific data set, and communicating said machine-specific and customer-specific data set directly to said franking device via said modem.

7. A method as claimed in claim 6 comprising producing a message at said franking device to prompt entry of further data into said franking device, and communicating said further data directly via said modem to the data center in said request data.

8. A method as claimed in claim 1 comprising storing said machine-specific and customer-specific data set in a transportable data carrier, and communicating said machine-specific and customer-specific data set directly to said franking device by physically transporting said data carrier from said data center to said franking device.

9. A method as claimed in claim 8 comprising requiring communication of said numerical code directly from said franking device to said data center before allowing transporting of said data carrier to said franking device.

* * * * *